US008213628B2

(12) United States Patent
Gaches

(10) Patent No.: US 8,213,628 B2
(45) Date of Patent: Jul. 3, 2012

(54) LISTENING DEVICE FOR CLEAR PERCEPTION OF SOUND SIGNALS IN A NOISY ENVIRONMENT

(75) Inventor: Olivier Gaches, Moudon (CH)

(73) Assignee: Amplifon A.G., Baar (CH)

( * ) Notice: Subject to any disclaimer, the term of this patent is extended or adjusted under 35 U.S.C. 154(b) by 1141 days.

(21) Appl. No.: 11/988,445

(22) PCT Filed: Jul. 7, 2006

(86) PCT No.: PCT/IB2006/052311

§ 371 (c)(1),
(2), (4) Date: Jan. 11, 2008

(87) PCT Pub. No.: WO2007/007265

PCT Pub. Date: Jan. 18, 2007

(65) Prior Publication Data

US 2009/0202085 A1 Aug. 13, 2009

(30) Foreign Application Priority Data

Jul. 8, 2005 (CH) ..... 1138/05

(51) Int. Cl.
*H03B 29/00* (2006.01)

(52) U.S. Cl. ..... 381/71.4; 381/71.6; 381/370

(58) Field of Classification Search ..... 381/71.4, 381/71.6, 370

See application file for complete search history.

(56) References Cited

U.S. PATENT DOCUMENTS

| | | | | |
|---|---|---|---|---|
| 2,408,494 | A | 10/1946 | Veneklasen | |
| 5,138,664 | A * | 8/1992 | Kimura et al. | 381/71.6 |
| 6,567,524 | B1 * | 5/2003 | Svean et al. | 381/71.1 |
| 6,683,965 | B1 | 1/2004 | Sapiejewski | |
| 2003/0053650 | A1 | 3/2003 | Wang | |

FOREIGN PATENT DOCUMENTS

| | | |
|---|---|---|
| DE | 32 35 989 | 4/1983 |
| GB | 2 203 017 | 10/1988 |
| WO | 02/17837 | 3/2002 |

OTHER PUBLICATIONS

International Search Report for PCT/IB2006/052311 mailed Nov. 22, 2006.
English Translation of Written Opinion of the International Searching Authority.

* cited by examiner

*Primary Examiner* — Zandra Smith
*Assistant Examiner* — Paul Patton
(74) *Attorney, Agent, or Firm* — Nixon & Vanderhye P.C.

(57) ABSTRACT

The invention concerns a listening device (1) for transmitting electroacoustic signals comprising an earphone (2) and means for connecting said earphone (2) with a remote electroacoustic source (3). The invention is characterized in that it comprises an acoustic filter (4) and that its shape is perfectly adapted to the external auditory canal of the ear so as to provide sufficient soundproofing to the external environment. The invention also concerns a headphone comprising one or two such listening devices.

14 Claims, 5 Drawing Sheets

LISTENING DEVICE FOR CLEAR PERCEPTION OF SOUND SIGNALS IN A NOISY ENVIRONMENT

This application is the U.S. national phase of International Application No. PCT/IB2006/052311 filed 7 Jul. 2006 which designated the U.S. and claims priority to Switzerland Patent Application No. 01138/05 filed 8 Jul 2005, the entire contents of each of which are hereby incorporated by reference.

FIELD OF THE INVENTION

The present invention relates to electroacoustic devices that transmit sounds into the ears of a person. It relates, more precisely, to the transmission of acoustic signals in a noisy environment.

PRIOR ART

Various devices exist that allow sounds to be channeled into a person's ears. This may be, for example, a set of earphones connected to a mobile telephone.

When located in a noisy environment, for example inside a helicopter, an aircraft or on a construction site, the hearing system must be protected from the point of view both of the pressure and of the sound level.

In order to meet the twin demands of the protection of the hearing system and of the transmission of electroacoustic signals, a helmet is used into which loudspeakers are incorporated that are disposed opposite the ears.

Even though such helmets may be satisfactory, there are however circumstances where the surrounding sound intensity is such that the quality of the transmission of the sounds between the loudspeakers and the ears is insufficient (adverse signal-to-noise ratio since too low).

GENERAL SUMMARY OF THE INVENTION

The problem that the present invention proposes to solve lies in improving the quality of the transmission of the electroacoustic signals in a noisy environment.

In the invention, the solution of the aforementioned problem consists of an earpiece which comprises an earphone and connection means for connecting said earphone with an electroacoustic source. The earpiece according to the invention is characterized in that it comprises an acoustic filter and in that its external shape is perfectly adapted to the concha of the auricle of the ear and also to the external auditory canal in such a manner as to ensure a sufficient sound insulation from the external environment.

In one embodiment of the invention, the connection means are designed to establish a wired connection between the earphone and the electroacoustic source.

In another embodiment of the invention, the connection means are designed to establish a wireless connection between the earphone and the electroacoustic source.

Preferably, the earpiece according to the invention is composed of a flexible material into which the earphone and the acoustic filter are incorporated.

The invention also relates to an assembly composed of an earpiece as was previously described in relation to a wired connection with the electroacoustic source, of a cable having one end fixed to the earphone and the other end fitted with a connector designed to connect onto a primary circuit for transmission of electroacoustic signals.

Advantageously, the assembly described above is integrated into a helmet comprising a loudspeaker and a primary circuit, the primary circuit being designed to establish communication between the loudspeaker and a remote electroacoustic source. The assembly according to the invention is connected onto the primary circuit in such a manner as to sample the signals coming from the electroacoustic source.

It goes without saying that the helmet may equally be equipped with two loudspeakers and the assembly may be composed of two earpieces, each group formed from a loudspeaker and an earpiece being designed for an ear.

The earpiece according to the invention offers several advantages. It notably provides an ergonomic protection against noise in aircraft and helicopters, and a clear perception of the radio signals and alarms in the cockpit. The results prove that the system provides considerable advantages with respect to the devices of the prior art.

The earpiece according to the invention may advantageously be used in any noisy moving vehicle (racing car, etc.). It may also be used by the people in contact with vehicle drivers (mechanics on the tarmac, in the pits, etc.).

The non-exhaustive list presents several advantages offered by the invention:

- Improvement in communications and in security and safety on flights;
- Improvement in the performance of the pilots;
- Addition of redundancy with respect to the loudspeakers;
- High level of communication in a noisy environment;
- High level of comfort;
- Enhanced protection of the auditory system with respect to the surrounding noise.

DETAILED SUMMARY OF THE INVENTION

The invention is described in more detail hereinafter by means of examples illustrated in the following figures.

Figure 1:
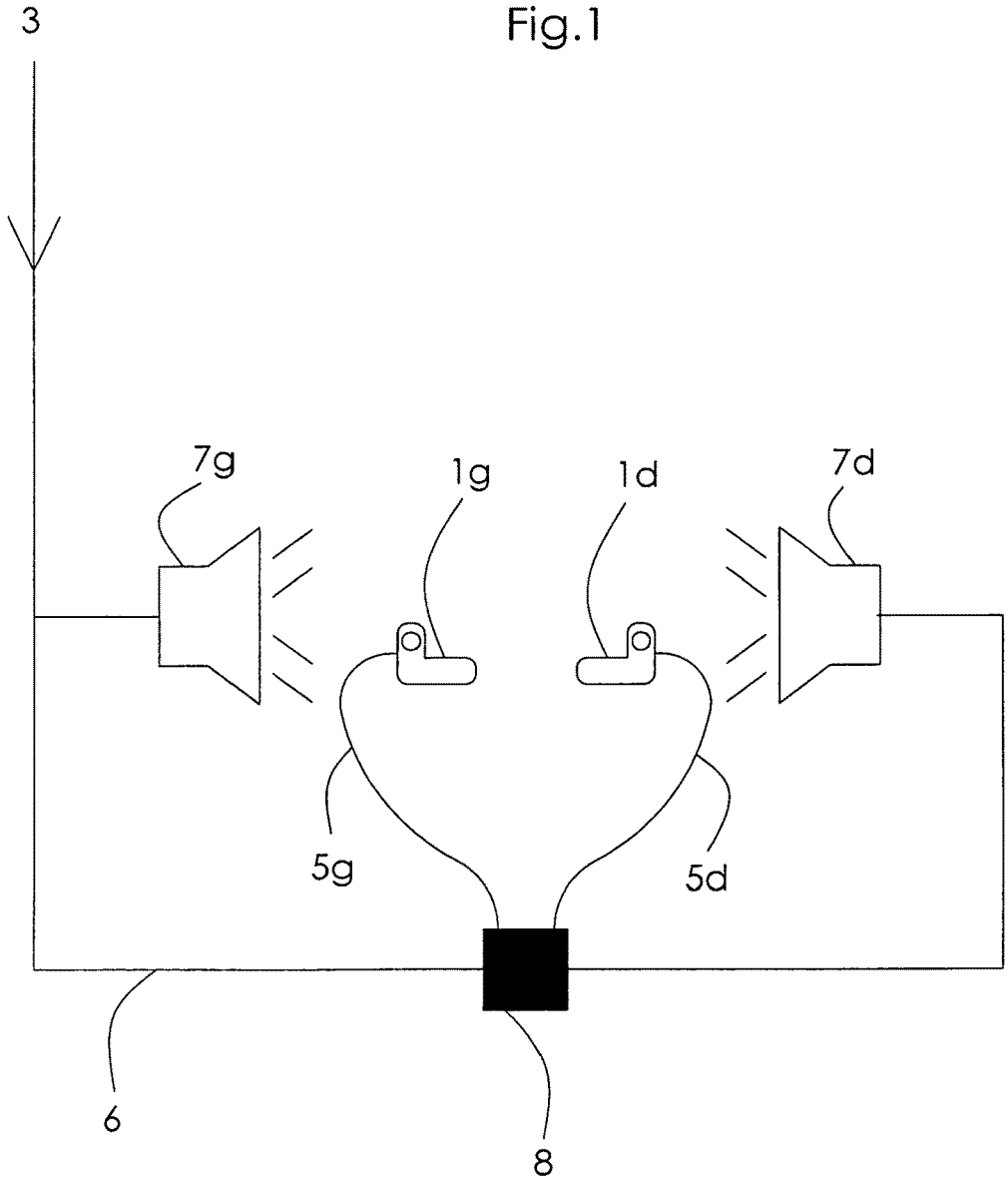
FIG. 1 shows a schematic circuit diagram of one embodiment of a helmet according to the invention.

In the example illustrated in FIG. 1, the sound is input via a primary circuit which comprises a left loudspeaker and a right loudspeaker, the two loudspeakers preferably forming part of a helmet. The device additionally comprises a pair of earpieces connected to the primary circuit by means of a connector.

Figure 2:
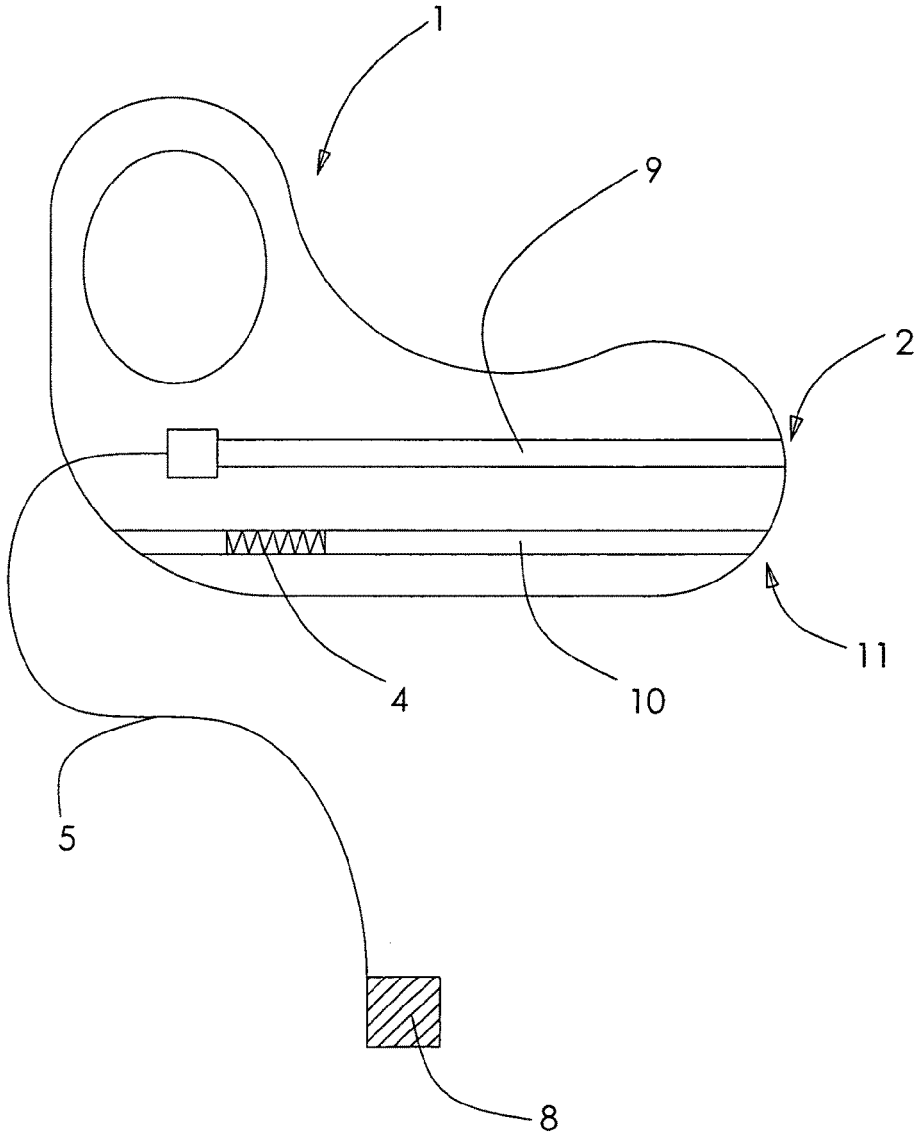
FIG. 2 shows one example of earpiece according to the invention.
Figure 3:
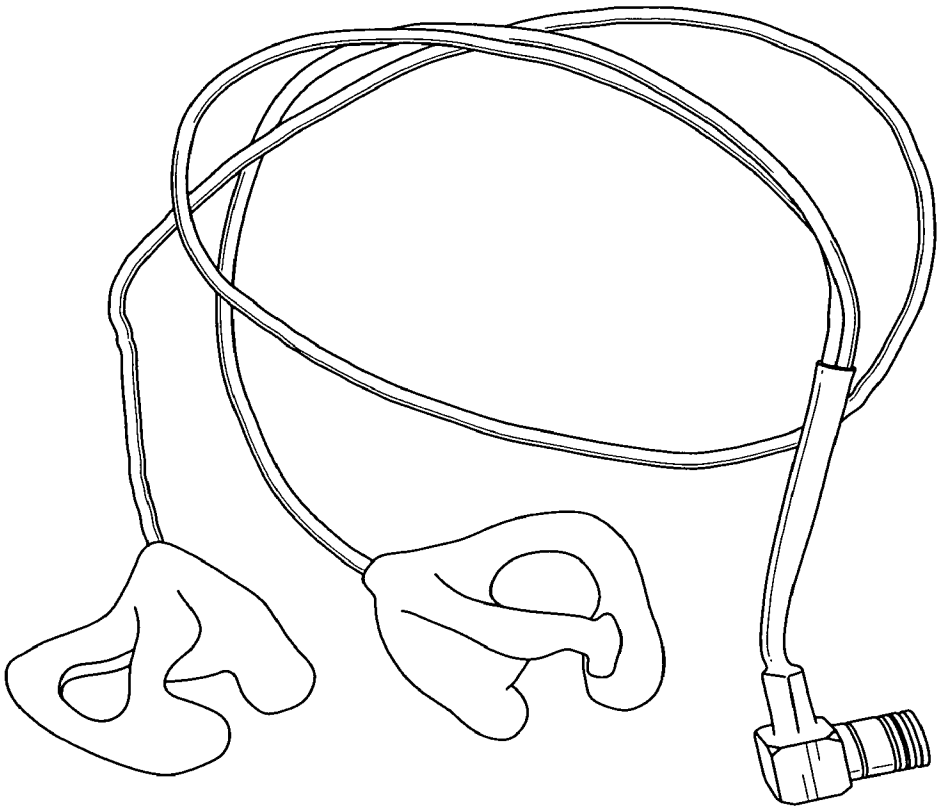
FIG. 3 shows an assembly of earpieces wired according to the invention.

According to one embodiment illustrated in FIG. 2, each earpiece comprises a miniaturized earphone and a filter. These two elements are incorporated into the earpiece. The earphone is situated in an active channel which allows it to be linked with the source of the signals via cable.

The filter is situated in a passive channel: it allows noise that may interfere with the signals to be eliminated.

Thanks to the presence of the earphones within the auditory canal, and advantageously of the filter, the perception of the acoustic signals is considerably improved.

In the example in FIG. 1, the loudspeakers can remain active. They may equally not be or, more simply, not be there.

Figure 4:
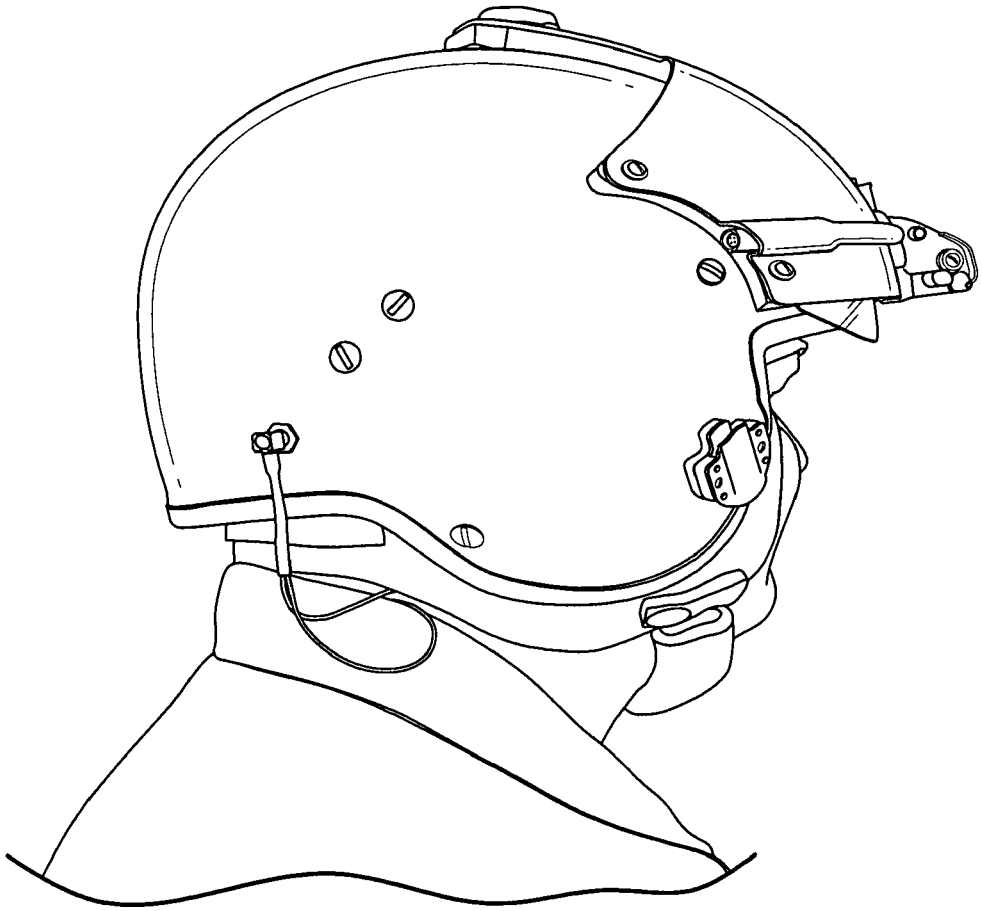
FIG. 4 shows a helmet according to the invention.

The connector allows the signals transmitted over the primary circuit to be sampled. In FIG. 4, the sound input, integrated into a helmet, allows the left loudspeaker and the right loudspeaker to be fed.

Figure 5:
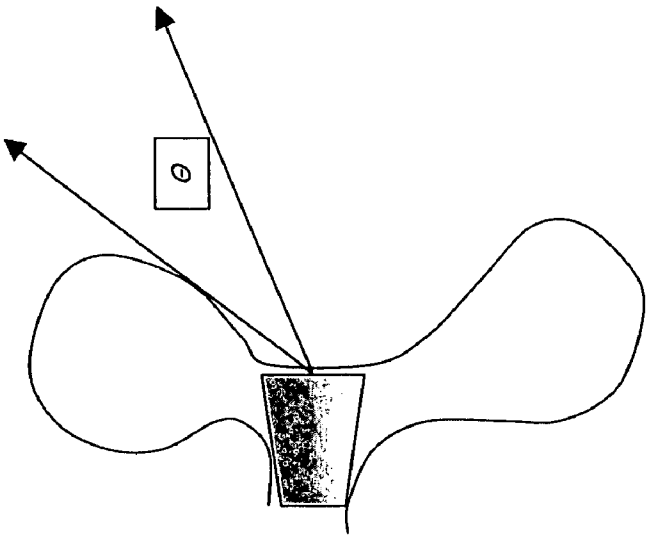
FIG. 5 shows the independence between the movement of the cable and that of the end-plug.

As can be seen in FIG. 5, moving the cable (oscillation) does not lead to a movement of the earpiece.

Features, variants and other advantages offered by the invention are summarized in the following table:

| Feature of the invention | Comments |
|---|---|
| Complete multifunctional integration | The total integration of the earphone and of the filter into a uniform volume allows:<br>the air pressure to be equalized (compensation for the variations in altitude)<br>the alarm signal from the cockpit to be heard<br>the radio signal to be transmitted use with the helmet |
| Choice of the cable | EMI: advantage of coaxial/twisted pair<br>Radius of curvature designed to be ergonomic<br>Passage through the groove<br>The finite angle θ allows the movements of the cable and of the earpiece to be independent (see FIG. 5)<br>The flexibility threshold is favorable for coaxial cable<br>Ejection-safe connection for the pilot. The pull-away threshold is designed for the safety of the pilot (no auricular injuries).<br>The presence of the vent hole with the filter provides progressive decompression in the case of accidental pulling out (risk of injury by abrupt decompression eliminated) |
| Flatness of the end-plug | Tailor-made system, perfectly integrated into the body form<br>The helmet constraints have been taken into account<br>This flatness allows the device to be used with the helmet without risk of damage and with an optimum comfort of use<br>Idea of physical invisibility (no protrusion, the device is within the auditory canal and not intra-concha) |
| Choice of the material | The material allows the device to "self-adapt" to the variabilities of the body form (auricle)<br>has properties optimized for a perfect fit to the auricle, a perfect compatibility with the accelerations, decelerations, pressure variations<br>Properties: Shore hardness (from 45 to 80), resistance to tearing |
| Association of heterogeneous technologies | The combination of several technologies is innovative<br>Wireless transmission<br>Miniaturized electronics<br>Optimized material<br>in-ear monitoring |

The invention claimed is:

1. An hearing device for clear perception of acoustic signals in a noisy environment such as in a cockpit of an aircraft or a helicopter, said device comprising an earpiece incorporating at least an earphone situated in an active channel and connection means for connecting said earphone with a remote electroacoustic source, wherein the earpiece also comprises acoustic perception means for perception of acoustic signals in said noisy environment, said acoustic perception means comprising an acoustic filter situated in a passive channel, said acoustic filter being adapted to eliminate noises which may interfere with useful acoustic signals such as an alarm signal from the cockpit, said earpiece also having an external shape which is adapted to a concha of an auricle of the ear and also to an external auditory canal in such a manner as to ensure a sufficient sound insulation from the noisy environment.

2. The device as claimed in claim 1, in which said connection means are designed to establish a wired connection between the earphone and the electroacoustic source.

3. The device as claimed in claim 1, wherein said connection means are designed to establish a wireless connection between the earphone and the electroacoustic source.

4. The device as claimed in claim 1, wherein the earpiece is composed of a flexible material into which the earphone and the acoustic filter are incorporated.

5. The device as claimed in claim 1, also comprising a primary circuit for transmission of electroacoustic signals, said earpiece being connected to the primary circuit by a cable.

6. The device according to claim 5 further comprising a helmet incorporating at least a loudspeaker connected to said primary circuit.

7. An hearing device for clear perception of acoustic signals in a noisy environment in a cockpit of an aircraft or a helicopter, said device comprising an earpiece incorporating at least an earphone situated in an active channel and connection means for connecting said earphone with a remote electroacoustic source, wherein the earpiece further comprises acoustic perception means for perception of acoustic signals in said noisy environment, said acoustic perception means comprising an acoustic filter situated in a passive channel, said acoustic filter being adapted to eliminate noises which may interfere with a useful acoustic signal, said earpiece also having an external shape which is adapted to a concha of an auricle of the ear and also to an external auditory canal in such a manner as to ensure a sufficient sound insulation from the noisy environment.

8. The device as claimed in claim 7, in which said connection means are designed to establish a wired connection between the earphone and the electroacoustic source.

9. The device as claimed in claim 7, wherein said connection means are designed to establish a wireless connection between the earphone and the electroacoustic source.

10. The device as claimed in claim 7, wherein the earpiece is composed of a flexible material into which the earphone and the acoustic filter are incorporated.

11. The device as claimed in claim 7, also comprising a primary circuit for transmission of electroacoustic signals, said earpiece being connected to the primary circuit by a cable.

12. The device according to claim 11 further comprising a helmet incorporating at least a loudspeaker connected to said primary circuit.

13. The device according to claim 7, wherein the useful acoustic signal is an alarm signal from the cockpit.

14. The device according to claim 7, wherein the useful acoustic signal is a radio signal from the cockpit.

* * * * *